169-47 SR

10/2/79 OR 4,169,508

United States Patent [19]

Jauros et al.

[11] 4,169,508

[45] Oct. 2, 1979

[54] METHOD AND APPARATUS FOR FIRE EXTINGUISHING

[75] Inventors: Ensi A. Jauros, Helsinki; Tapani M. Ojala, Karhula, both of Finland

[73] Assignee: A. Ahlstrom Osakeyhtio, Noormarkku, Finland

[21] Appl. No.: 845,353

[22] Filed: Oct. 25, 1977

[51] Int. Cl.[2] ..... A62C 1/08; A62C 27/00

[52] U.S. Cl. ..... 169/47; 169/68; 169/91; 406/80; 406/100

[58] Field of Search ..... 169/43, 46, 47, 68, 169/70, 30, 91; 214/83, 28; 239/654, 655, 672; 302/2 A, 11, 21, 23, 37, 57

[56] References Cited

U.S. PATENT DOCUMENTS

| | | | |
|---|---|---|---|
| 1,374,232 | 4/1921 | Reed | 302/37 |
| 1,863,920 | 6/1932 | Costa | 169/91 X |
| 1,898,759 | 2/1933 | Burt | 302/2 A X |
| 1,936,173 | 11/1933 | Orth | 302/37 X |
| 1,982,192 | 11/1934 | Baumgarten | 169/91 |
| 2,561,701 | 7/1951 | Hurlbert | 169/91 X |
| 2,669,271 | 2/1954 | Treckmann | 239/654 X |
| 3,500,934 | 3/1970 | Magnuson | 169/46 |

*Primary Examiner*—Johnny D. Cherry

*Attorney, Agent, or Firm*—Bucknam and Archer

[57] ABSTRACT

A method for extinguishing fires which is particularly suited for extinguishing burning liquids. The area of the fire is covered by granulated or chopped mineral wool which is spread out over the fire in a sufficiently thick layer. The apparatus for carrying out the method consists of a blower which is provided with knives by means of which the mineral wool may be granulated. The apparatus can be used for removing the mineral wool after the fire has been extinguished.

5 Claims, 4 Drawing Figures

Fig. 2
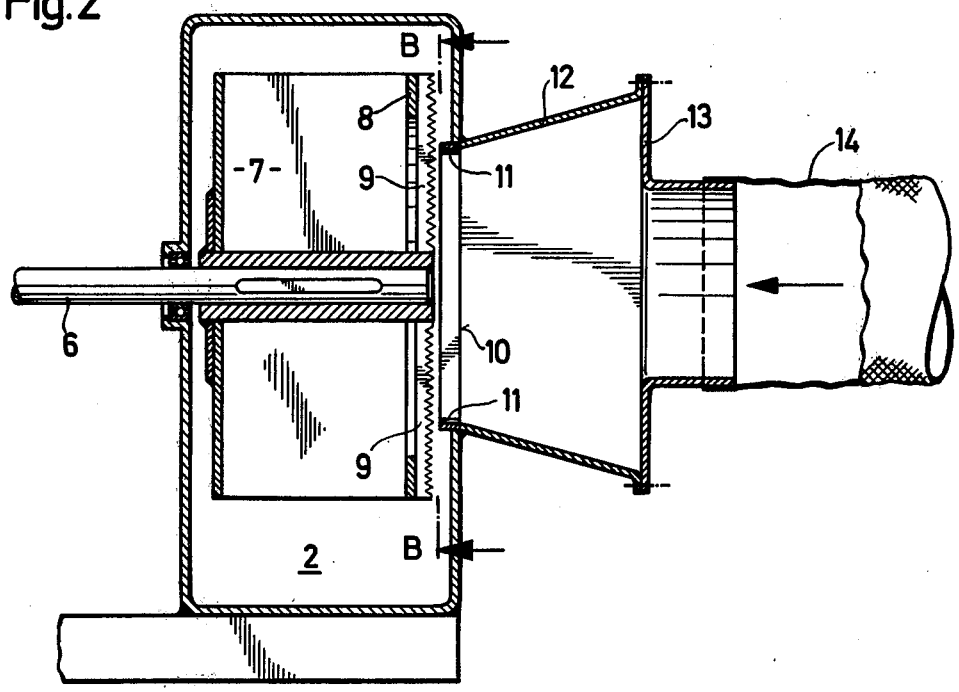
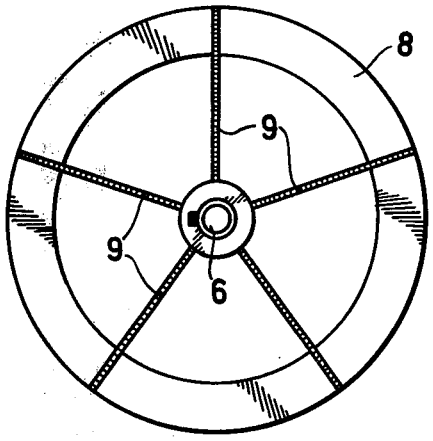
Fig. 3

METHOD AND APPARATUS FOR FIRE EXTINGUISHING

BACKGROUND OF THE INVENTION

1. Field of the Invention

The present invention relates to a method and an apparatus for fire extinguishing which are particularly suitable for extinguishing burning liquids.

2. Prior Art

To extinguish a fire, the temperature has to be reduced, the free access to the oxygen of the air has to be prevented, or the burning material has to be removed. Each of the aforementioned factors is sufficient for extinguishing the fire but, depending on the circumstances, one usually tries to use the two first-mentioned in combination.

The most common and most universal extinguishing means is water, the ability of which to extinguish is due to its cooling effect. It is however usually not suitable for extinguishing burning liquids. Nowadays various foams are used for fire extinguishing, for the generation of which water is also needed. The ability of the foams to extinguish fire is due to their cooling effect and partly to their smothering effect, i.e. they prevent the free access of the oxygen of the air, which is necessary for the burning. The foams are quite suitable for extinguishing many burning liquids. The ability of powders to extinguish fires is due to their prevention of the free access of the air to the object of the fire. Various oxygen-free gases are also used for fire extinguishing. Their ability to extinguish fire is due to the fact that they, being heavier than the air, displace the air from the object of the fire or mix with the air, whereby the proportion of the oxygen becomes so small that burning is impossible.

The use of the abovementioned fire extinguishing means is restricted or hampered by the following circumstances.

Burning liquids and eletrical fires cannot be extinguished by water with the exception of a few cases. Unskillfully used or because of difficult conditions, the damages caused by the water can be worse than those caused by the fire. Common water damages are interruption of production for long periods and damage to the buildings. Lack of water as a rule means that a small fire turns into a big fire, because the firebrigade can only carry small quantities of water. The oil harbours are usually located in such a manner that water for extinguishing is not obtainable from the sea even if they are near it. The most common reason for that are shallow shores or that there is not enough space for sufficient fire-fighting equipment at the source of the water supply. Usually the size of the water pipes and the available amount of water are not large enough to supply water sufficiently for extinguishing burning oil cisterns and entrenchments and for cooling adjacent cisterns.

If there is not water, no foam can be produced. The heavy protein base foams need plenty of water because the portion of the foaming liquid in the extinguisher-foam is only 8%. If protein base foams come into contact with air in their storage containers, the decay process starts immediately and after a year they are usually spoiled. The half-life of the foams is about 5–10 min., whereas 30 min. is required. The light synthetic foams cause intensive corrosion. On the other hand, they move easily by air currents because of their lightness. The foams cannot, whether heavy or light, prevent burning liquid from moving or flowing, because they do not absorb the burning liquid but aim at forming a foam layer on them in order to prevent air from mixing with the vapours from the burning liquid. The heavy foams can by means of a fire-engine be thrown only about 25 m, which means that its operating distance is rather short. Light foams can, owing to their lightness, only be transferred about 12 m at the most by means available today.

Powders are usually used only indoors and they are generally used as extinguishing means in preliminary fire extinguishers. A fire foam truck can actually be used only once and has to be refilled when empty. A refill takes at present more than 30 min. and during this time the fire has already increased so much that it is impossible to extinguish it with powder. Powders do not have any cooling effect.

Gases can successfully be used indoors only or in the preliminary stages of small fires. They have no cooling effect. Most gases which are used for extinguishing purposes are poisonous or become poisonous when they decompose.

SUMMARY OF THE INVENTION

It is an object of the invention to provide a fire extinguishing method which eliminates the abovementioned drawbacks.

It is an essential feature of the method of the invention that the area of the fire is covered by incombustible material in the form of fibers having good absorption capacity, such as mineral wool. Particularly suitable for this purpose is granulated or chopped glass wool which is spread out over the area of the fire in a sufficiently thick layer by a spreading apparatus located at a distance from it. According to one preferred embodiment, the granulated glass wool is transferred to its destination by an air jet generated by a blower mounted on a removable supporting frame.

The method is particularly suitable for extinguishing burning liquids, and it has been proved by tests that its use involves the following advantages:

- the granulated mineral wool can be thrown further than for instance heavy foams
- mineral wool absorbs an amount of burning liquid corresponding to its own volume and emits vapours only slowly
- due to its absorption capacity, mineral wool prevents a burning liquid from spreading
- due to its absorption and heat insulation capacity, mineral wool limits the heat radiation and thus makes it possible for the fireman to get near the fire
- if the burning liquid in the mineral wool cannot be combusted or destructed at the scene of the fire, it can easily be transferred to another place
- the burning liquid can be removed, for instance by squeezing it out, whereby the mineral wool can be reused
- only a small portion of the mineral wool will be sintered, wherefor it can be reused
- the mineral wool does not cause water damages as water and heavy foams do
- the storage life of mineral wool is unlimited, and it can be stored everywhere. It does not have any half-life.
- mineral wool is a common article of commerce and easily obtainable.

EXAMPLE

The method was tested by extinguishing 2000 l of burning mixture of xylene and paint which was in a basin having a size of 4×7 m. The fire was extinguished by spreading 5 $m^3$ granulated glass wool evenly over the area of the basin by means of the apparatus shown in FIG. 1. The fire was extinguished in 3 min. 42 seconds. When beginning the extinguishing the flames were over 10 m high. In the applied embodiment, the diameter of the rotor of the blower was 500 mm and its rotational speed 3000 r/min. The maximal throwing range of the granulated glass wool was about 75 m. With a rotor having a larger diameter it would be possible to reach even farther.

DESCRIPTION OF THE DRAWINGS

The invention is described more in detail below with reference to the enclosed drawings in which FIG. 2 shows the portion A of FIG. 1 more in detail, FIG. 3 shows a sectional view taken along line B—B of FIG. 2.

Figure 1:
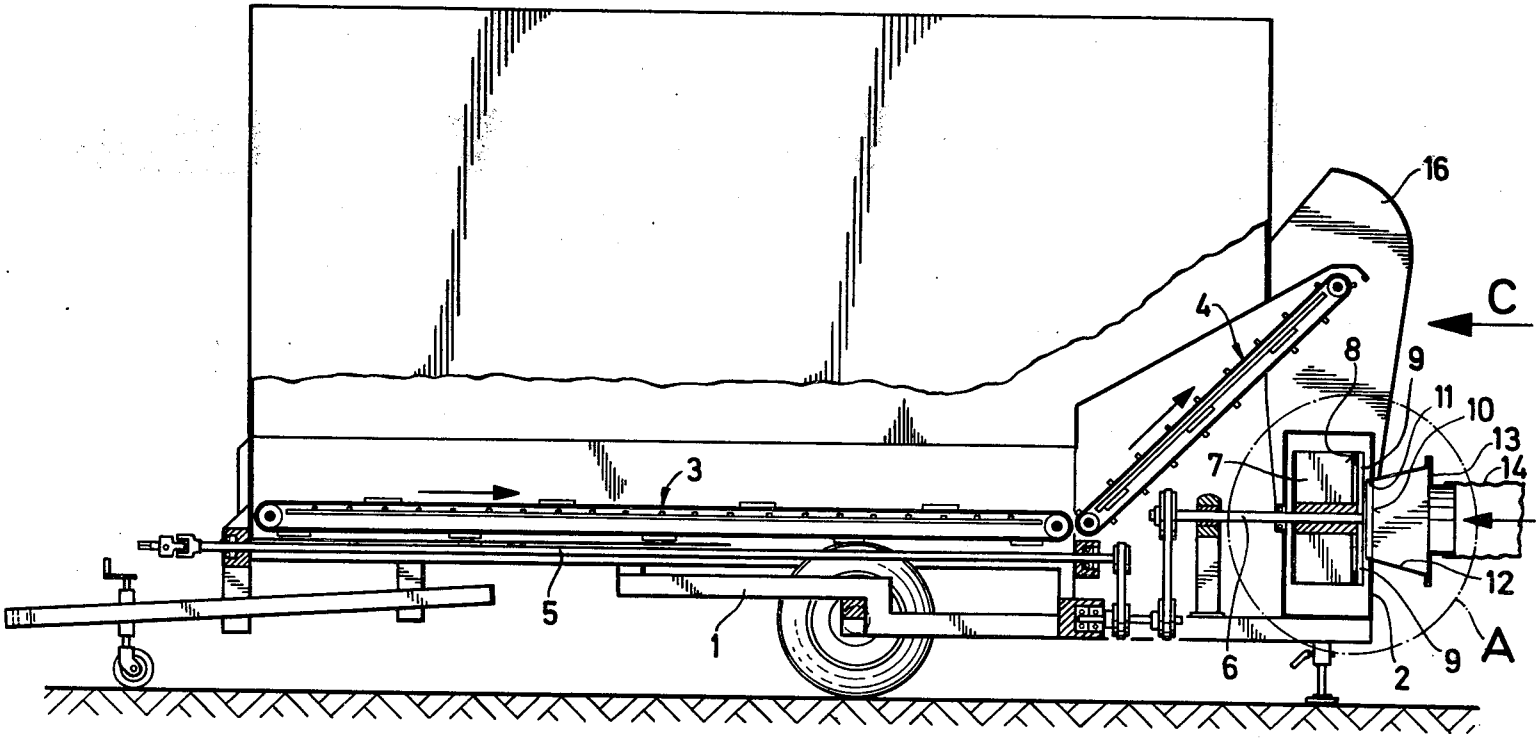
FIG. 1 shows a side view taken on an axial section of a preferred embodiment of an apparatus intended for applying the method of the invention.
Figure 4:
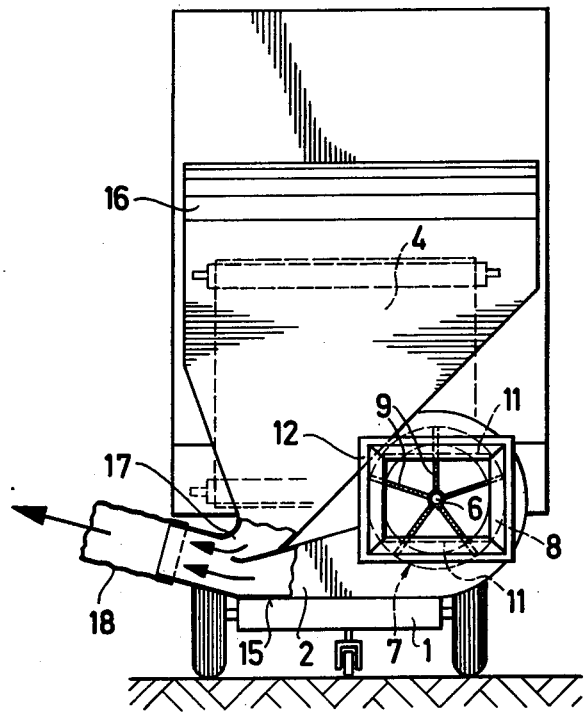
FIG. 4 shows a view of the apparatus in the direction of arrow C of FIG. 1.

In the drawings the numeral 1 refers to the supporting frame of a trailer having wheels and a drawbar, on which is mounted a blower 2, a conveyor 3, a proportioning elevator 4, and a power shaft 5 by means of which the power from a tractor connected to the trailer is transmitted to the conveyor, the proportioning elevator and the blower.

In the blower there is a rotable shaft 6 mounted in bearings at its other end, to which a rotor 7 provided with vanes is attached. In front of the suction port of the rotor there are radial knives 9 connected to a ring 8 and on both sides of a rectangular inlet port 10 in the end wall of the blower casing there are counterknives 11. Both knives can be serrated as shown in FIG. 2. Alternatively one of them or both can be straight. A supply funnel 12 to which a flange 13 and a preferably elastic suction hose 14 can be connected is attached to the end wall. An outlet channel 15 of the blower communicates with a funnel 16 through an opening 17 in the lower end of the funnel. A flexible pressure hose 18 is connected to the end of the outlet channel.

The apparatus has the following alternative functions:

The granulated mineral wool in the trailer is transferred by the conveyor 3 to the proportioning elevator 4 which drops it evenly proportioned in the supply funnel 16. It is then sucked through the opening 17 in the lower end of the funnel into the outlet channel 15 of the blower by the airflow caused by the blower. By moving the end of the pressure hose attached to the outlet channel the granulated mineral wool can be conducted to the desired place and distributed over the area of the fire. If the mineral wool is not in a granulated form, it is supplied through the supply funnel 12, whereby the knives 9 attached to the rotor and the counter knives 11 attached to the casing granulate the mineral wool, when the rotor rotates and the blower throws the granulated mineral wool farther. The apparatus can also be used for removing of the distributed mineral wool to the container after the fire has been extinguished. The suction hose 14 is then connected to the supply funnel of the blower. The end of the suction hose is moved over the mineral wool to be removed and it is conducted to the mineral wool container by the outlet hose 18.

The invention is not limited to the embodiments illustrated by the drawings or the example. Without departing from the principle of the invention, the mineral wool can, for instance, be conducted to the fire area by a water jet.

What is claimed is:

1. A method for extinguishing fires burning on a liquid, which comprises introducing comminuted mineral wool into an airstream for carrying thereby in admixture therewith; and directing said airstream to the burning liquid to deposit upon said liquid a layer of comminuted mineral wool that extinguishes the fire burning on said liquid.

2. A method according to claim 1 wherein the layer of mineral wool deposited upon the liquid has a thickness sufficient to absorb said liquid.

3. An apparatus for extinguishing fires which comprises a container for storing comminuted solid, fire extinguishing material; a blower with a rotary impeller within a casing having an inlet port and an outlet port; cutting means positioned adjacent said inlet port and including knife parts mounted on said casing and cooperating knife parts mounted on said impeller for rotation therewith to comminute solid fire extinguishing material drawn through said inlet port by suction from the rotation of the impeller, outlet conduit means flow connected to said outlet port to receive therefrom an airstream established by the rotation of said impeller; and feeder conduit means flow connected to said container and to said outlet conduit means; said outlet conduit means having an outlet end selectively movable to a first position to discharge toward a fire to be extinguished and to a second position to discharge into said container, whereby in one mode of operation, comminuted fire extinguishing material flows from the container through the feeder conduit means into the outlet conduit means for admixture with the airstream and conveyance thereby for discharge toward a fire with said outlet end of the outlet conduit means in said first position, and in a second mode of operation fire extinguishing material drawn through said inlet port is comminuted by the cutting means, introduced into the airstream and conveyed thereby for discharge toward a fire with said outlet end of the outlet conduit means in said first position, and in a third mode of operation comminuted fire extinguishing material drawn through said inlet port is conveyed by the airstream and discharged into the container, with said outlet end of the outlet conduit means in said second position.

4. An apparatus according to claim 3 wherein said outlet conduit means includes an elongated flexible hose section.

5. An apparatus according to claim 3 including a flexible hose section connected to said inlet port.

* * * * *